US009416507B2

(12) United States Patent
Hotchkin

(10) Patent No.: US 9,416,507 B2
(45) Date of Patent: Aug. 16, 2016

(54) IMPACT ABSORBING POLE

(75) Inventor: Darren J. Hotchkin, Labertouche (AU)

(73) Assignee: Saferoads Pty Ltd., Victoria (AU)

( * ) Notice: Subject to any disclaimer, the term of this patent is extended or adjusted under 35 U.S.C. 154(b) by 0 days.

(21) Appl. No.: 12/587,930

(22) Filed: Oct. 14, 2009

(65) Prior Publication Data

US 2010/0107521 A1 May 6, 2010

(30) Foreign Application Priority Data

Oct. 15, 2008 (AU) ..... 2008229948

(51) Int. Cl.
*E01F 15/04* (2006.01)
*E01F 13/02* (2006.01)

(52) U.S. Cl.
CPC ..... *E01F 15/0461* (2013.01); *E01F 13/02* (2013.01)

(58) Field of Classification Search
CPC ..... E01F 9/0175; E01F 9/0186; E01F 9/0182; E01F 9/0117; E01F 9/017; E01F 15/0461; E01F 9/011; E01F 9/018; E01F 13/02; E01F 13/026; E01F 13/028
USPC ..... 52/40, 98, 169.13, 170, 843; 248/156, 248/530, 545; 404/10; 256/1, 13.1, 65.14; 403/2
See application file for complete search history.

(56) References Cited

U.S. PATENT DOCUMENTS

| | | | | |
|---|---|---|---|---|
| 1,821,850 | A * | 9/1931 | Riemenschneider | 138/173 |
| 3,217,459 | A * | 11/1965 | Meyer | 52/28 |
| 3,628,296 | A * | 12/1971 | Henry | 52/98 |
| 4,196,550 | A * | 4/1980 | Svensson | 52/98 |
| 4,630,413 | A * | 12/1986 | Svensson | 52/98 |
| 4,747,725 | A * | 5/1988 | Gebelius | 404/10 |
| 5,090,348 | A * | 2/1992 | Hugron | 116/63 P |
| 5,267,523 | A * | 12/1993 | Hugron | 116/63 R |
| 5,860,253 | A * | 1/1999 | Lapointe | 52/98 |
| 6,264,162 | B1 * | 7/2001 | Barnes et al. | 248/548 |
| 6,516,573 | B1 * | 2/2003 | Farrell et al. | 52/98 |
| 2005/0196235 | A1 * | 9/2005 | Strick | 404/10 |
| 2008/0131201 | A1 * | 6/2008 | Audet | 404/10 |
| 2008/0308707 | A1 * | 12/2008 | Goossens | 248/548 |
| 2013/0008096 | A1 * | 1/2013 | Griffiths | E01F 9/0182 52/99 |
| 2014/0043836 | A1 * | 2/2014 | Welandson | 362/431 |

FOREIGN PATENT DOCUMENTS

| | | |
|---|---|---|
| AU | 546648 B2 | 9/1985 |
| DE | 1811147 A1 | 6/1970 |

(Continued)

OTHER PUBLICATIONS

European Search Report dated Apr. 8, 2011, corresponding to EP 09 17 3003.

*Primary Examiner* — Robert Canfield
*Assistant Examiner* — Babajide Demuren
(74) *Attorney, Agent, or Firm* — Mintz Levin Cohn Ferris Glovsky and Popeo, P.C.; Peter F. Corless; Carolina E. Säve

(57) ABSTRACT

An impact absorbing pole 5 is disclosed. The pole is formed as a one-piece unit that includes an outer wall 7 and a hollow interior 9 and has a base section 11 for locating the pole below the ground and a pole section 13 for extending upwardly above the ground. The pole is formed so that, in use, the pole can deform above and below ground level when the pole is installed in the ground and is contacted by a vehicle.

4 Claims, 3 Drawing Sheets

(56) References Cited

FOREIGN PATENT DOCUMENTS

| | | | | |
|---|---|---|---|---|
| EP | 0001964 | A1 | | 5/1979 |
| FR | 2842851 | B1 | * | 12/2004 |
| GB | 2268774 | A | * | 1/1994 |
| WO | 8404117 | A1 | | 10/1984 |
| WO | WO 2005064084 | A1 | * | 7/2005 |

* cited by examiner

IMPACT ABSORBING POLE

The present invention relates to impact absorbing poles.

The present invention relates particularly, although by no means exclusively, to impact absorbing poles of a type that are made from steel sheet that is bent or otherwise formed into a tubular structure and are at least 6 m long and designed to selectively deform, i.e. flatten, on initial impact with a vehicle and then progressively extrude as the vehicle moves forward after initial impact and ultimately bend (in effect, collapse), preferably in a controlled way, rearwardly over the roof of the vehicle. In effect, the rearwardly bent pole confines the vehicle.

As is evident from the above paragraph, the term "impact absorbing pole" is herein understood to describe a category of poles that are constructed to at least partially absorb the impact of a vehicle with a pole of this type and to at least partially confine the vehicle when the vehicle contacts the pole. This is a different category of poles to standard non-impact poles which are only designed to absorb impact.

The present invention is concerned particularly, although by no means exclusively, with street lighting poles that include outwardly extending arms that mount street lights.

According to the present invention there is provided an impact absorbing pole that is formed as a one-piece unit that includes an outer wall and a hollow interior and has a base section for locating the pole below the ground and a pole section for extending upwardly above the ground and is formed so that, in use, the pole can deform above and below ground level when the pole is installed in the ground and is contacted by a vehicle.

Forming the pole as a one piece unit that has above ground and below ground sections that can deform on impact of a vehicle means that it is not necessary to form the pole from two sections with connecting flanges on each section that form a heavy base plate that interconnects the sections. This is the structure of currently used impact absorbing poles, with one section forming a below ground base section and the other section forming an above ground pole section. The connecting flanges are bolted together when the pole is used for low speed applications and the connecting flanges are held together via a slip connection for high speed applications. The currently used two-piece pole is designed to absorb impact and confine vehicle movement—it is used particularly in pedestrian areas where it is important that the pole collapse in a controlled way back on to the vehicle rather than onto pedestrians. The rationale behind the use of a two-piece unit is that the base section of the pole will not be damaged by impact of a vehicle and it is a straightforward matter to replace a damaged pole section with a new pole section and continue to use the original base section.

The applicant has found that such base plates of the currently used poles prevent below ground deformation of the pole and is a significant problem as a consequence. Energy absorption with impact absorbing poles occurs via progressive deformation, i.e. flattening, of the tubular structure of the pole on initial impact and then extrusion of the deformed sections as the vehicle moves forward after initial impact. The applicant has found that the base plate of the currently used two-piece pole prevents deformation of the pole downwardly beyond the base plate. Hence, deformation, and energy absorption, is confined to the sections of the pole that are above the base plate, with a result that the impact may result in an uncontrolled (and unsafe) collapse of the pole. This is a significant issue because an important objective of impact absorbing poles is to absorb energy and stop a vehicle in a controlled way so that occupants of the vehicle can survive the collision with the pole.

The applicant has found that the above-described pole of the present invention performs better in vehicle impact tests at low speeds (typically 60 km/hr or less) than the above-described currently used two-piece pole. The vehicle impact tests were carried out in accordance with specifications set down in VIC Roads TCS 014-3-2001 and AS/NZS 1158.1.3: 1997. The tests showed that the occupants would survive the impact of a vehicle travelling at 60 kph with a pole in accordance with the present invention.

The applicant has also found that the above-described pole of the present invention performs better in vehicle impact tests at high speeds (typically greater than 60 km/hr and up to 110 km/hr) in accordance with the above standards than the above-described currently used two-piece pole with separate above and below ground sections and a slip base connection that enables the above-ground section to disengage from the below-ground section on impact of a vehicle with the pole. At such high speeds, this known pole partially absorbs impact of a vehicle but does not completely confine the vehicle. On the other hand, the pole of the present invention was able to absorb higher amounts of energy in a controlled way.

One of the vehicle impact tests is described in more detail with reference to FIGS. 4 and 5 hereinafter.

Typically, the pole of the present invention is formed so that impact of a vehicle with the pole deforms, i.e. flattens, an area of the pole that is directly contacted by the vehicle initially and then extrudes other sections of the pole above and below this area of the pole as the vehicle moves forward after initial impact with the pole and ultimately bends (in effect, collapses) the pole rearwardly over the roof of the vehicle. The deformation and the subsequent extrusion absorb the impact energy. The bending of the pole over the roof of the vehicle confines the vehicle.

The pole may be formed from sufficiently low tensile strength steel that can deform and extrude readily above and below ground level when contacted by the vehicle.

The applicant has found that poles made from steel having a tensile strength of 235 MPa, which is considerably lower than the 250 MPa and 350 MPa steels for the currently used two-piece pole in Australia, performed considerably better than the higher tensile strength poles.

Typically, the pole of the present invention is made from steel in sheet form that is folded into a required cross-sectional shape and welded at abutting side edges.

Alternatively or in addition, the pole may be formed with an area of weakness that extends above and preferably below ground when the pole is installed in the ground and can deform and extrude readily above and below ground level when contacted by the vehicle.

Typically the area of weakness of the pole of the present invention is formed by cutting or otherwise providing shear slots in the pole.

The shear slots may extend at least partially along the length of the base section and at least partially along the length of the pole section so that the slots are located at least at ground level and preferably below ground when the pole is positioned in the ground.

The shear slots are positioned so that the pole deforms, i.e. flattens, in the area that is directly contacted by the vehicle and then extrudes the pole above and below this contact area as the vehicle moves forward after initial impact and then bends back (in effect, collapses) in a controlled way over the roof of a vehicle. The mode of failure is via deforming, i.e. crushing or flattening, of the pole initially at the area of impact and then above and below the impact area, which absorbs the energy of impact and results in the pole extruding above and below the area of impact and then ultimately bending rearwardly over the vehicle roof in a controlled way compared to the currently used two piece pole. Specifically, the forward movement of a vehicle after initial impact of the vehicle with the currently used two piece pole progressively deforms, i.e. extrudes, the pole along the length of the pole from the point of impact towards the top of the pole. With the present invention the pole is also free to deform, i.e. extrude, downwardly and below ground. This additional energy absorption is beneficial in stopping the vehicle with less force than is the case with currently used two-piece poles.

Typically, the shear slots are 1 to 10 cm long and up to 2 mm wide and are in lines of slots and are spaced apart by up to 1 cm in the lines, with the lines being spaced around the circumference of the pole.

Typically the shear slots extend at least 3.5 m, preferably at least 3.9 m, along the length of the pole.

Preferably the shear slots are at least predominantly in the base section of the pole that is below ground when the pole is positioned in the ground.

Typically, the pole has a diameter of at least 280 mm, and more preferably at least 300 mm, at a widest diameter section of the pole, which is typically the base section of the pole.

Preferably the pole is a tapered pole whereby the transverse cross-sectional area of the pole decreases away from a base end of the pole.

The pole may be any suitable transverse cross-section form circular to polygonal. An octagonal transverse cross-section is one suitable cross-section.

According to the present invention there is also provided an impact absorbing pole that is positioned in the ground, the pole being a one-piece unit that includes an outer wall and a hollow interior and has a base section that extends into and locates the pole in the ground and a pole section that extends upwardly from the ground and is formed so that, in use, the pole can deform above and below ground level when the pole is contacted by a vehicle.

Typically, the pole is formed so that impact of a vehicle with the pole initially deforms, i.e. flattens, the pole at an area of impact with the vehicle and then extrudes the pole above and below ground level as the vehicle moves forward after initial impact with the pole and then bends (in effect, collapses) the pole rearwardly over the roof of the vehicle in a controlled way.

The pole may be formed from sufficiently low tensile strength steel that can deform and extrude readily when contacted by the vehicle.

Typically, the pole is made from steel in sheet form that is folded into a required cross-sectional shape and welded at the abutting side edges.

Alternatively or in addition, the pole may be formed with an area of weakness that extends above and preferably below ground so that the pole can deform and extrude readily when contacted by the vehicle.

Typically the area of weakness of the pole is formed by cutting or otherwise providing shear slots in the pole.

Preferably the shear slots extend at least partially along the length of the below ground base section and at least partially along the length of the above ground pole section.

Typically, the pole has a diameter of at least 280 mm, and more preferably at least 300 mm, at a widest diameter section of the pole, typically a base end of the pole.

Preferably the pole is a tapered pole whereby the transverse cross-sectional area of the pole decreases away from the base end of the pole.

The pole may be any suitable transverse cross-section form circular to polygonal. An octagonal transverse cross-section is one suitable cross-section.

The present invention is described further by way of example with reference to the accompanying drawings, of which:

The impact absorbing pole generally identified by the numeral 5 shown in the Figures is adapted to be used as a street lighting pole that includes an outwardly extending arm (not shown) that mounts a street light and is designed for use in streets that have side walks with pedestrian traffic. It is noted that the present invention is not confined to poles used in this application.

Figure 1:
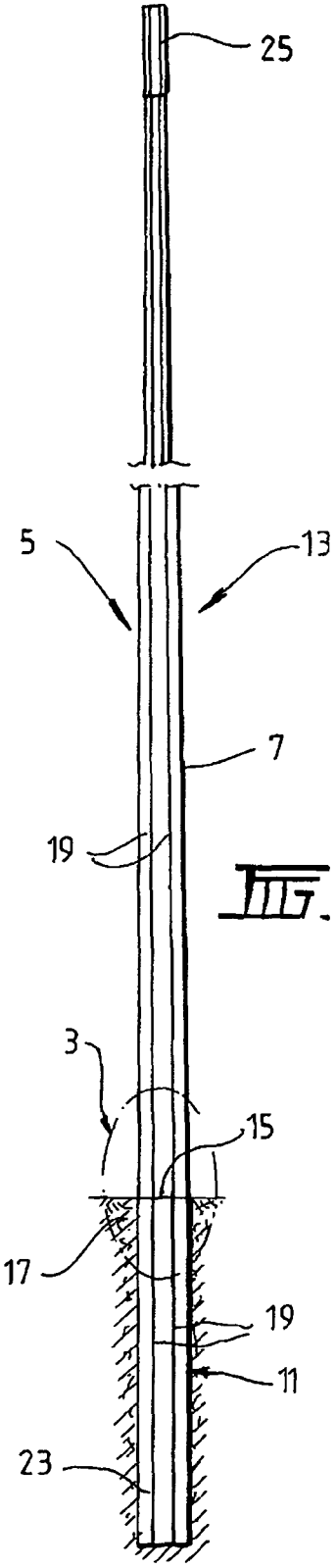
FIG. 1 is a side view of one embodiment of an impact absorbing pole in accordance with the present invention positioned in the ground.
Figure 2:
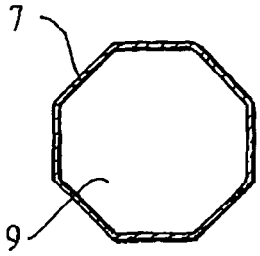
FIG. 2 is an end view of the base end of the pole shown in FIG. 1.

The pole 5 is formed as a one-piece unit from steel and has an outer wall 7 (FIG. 2) and a hollow interior 9 (FIG. 2). The pole 5 is octagonal in transverse section and tapers from a base end 23 to a top end 25. The pole 5 is 12 m long. The pole 5 has a base section 11 that locates the pole below ground and a pole section 13 that extends upwardly above ground. The interface between these sections of the pole is identified by the numeral 15 in FIGS. 1 and 3. In these Figures, the pole 5 is positioned in the ground 17 with the interface at ground level.

Figure 3:
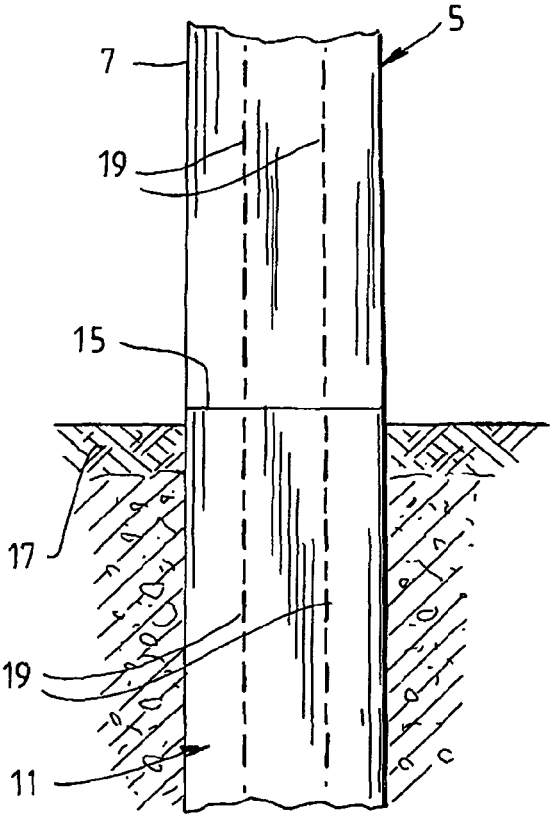
FIG. 3 is an enlarged view of the section of the pole identified by the numeral 3 in FIG. 1.

The pole 5 is formed so that, in use, the pole can deform above and below ground level when the pole is installed in the ground as shown in FIGS. 1 and 3.

Specifically, the pole 5 is formed with a series of lines of weakness in the form of a series of lines of shear slots 19 that extend at least partially along the length of the base section 11 and at least partially along the length of the pole section 13 so that the slots are located above and below ground level when the pole 5 is positioned in the ground 17.

In the pole shown in the Figures, the slots 19 are 100 mm long and 2 mm wide, the slots 19 in each line are spaced apart by 110 mm, and the lines of slots 19 are spaced around the circumference of the pole 5, with several lines of slots extending along the base section 11 and 3970 mm along the pole section 13 and at least one line of slots extending along the base section 11 and 1295 mm along the pole section 13.

The pole 5 is formed by cutting the slots in a 3 mm flat sheet of steel having a tensile strength of 235 MPa and then bending the sheet around the lengthwise extending axis of the sheet to form the required octagonal transverse cross-section member and welding the two side edges of the sheet to form the pole 5. As is indicated above, the use of the above-described steel is a departure from the requirement to use higher tensile steel in the currently used two-piece poles and contributes to the deformability of the pole on impact by a vehicle.

A pole 5 of the type shown in FIGS. 1 to 3 was tested in a vehicle impact test in accordance with VIC Roads TCS 014-3-2001 and AS/NZS 1158.1.3:1997.

The pole was positioned as shown in FIG. 1 in a 600 mm diameter hole and the hole was back-filled with stabilised sand.

A Ford Telstar sedan, 1988 model, mass 1200 kg was pulled with Nissan, 4 Patrol 2007 to an area of impact with the pole.

According to VIC TCS 014-3-2001 and AS/NZS 1158.1.3: 1997, a pole must restrain an impacting vehicle and collapse on the vehicle roof in order to minimise risk of injuring other members of the road traffic—see FIG. B2 in AS/NZS 1158.1.3:1007.

The pole initially impacted the vehicle roof and then bounced off the roof onto the ground.

The pole crumpled as required in VIC Roads TCS 014-3-2001 and AS/NZS 1158.1.3:1997, restraining the impacting vehicle and therefore passed the requirements of these tests.

Figure 4:
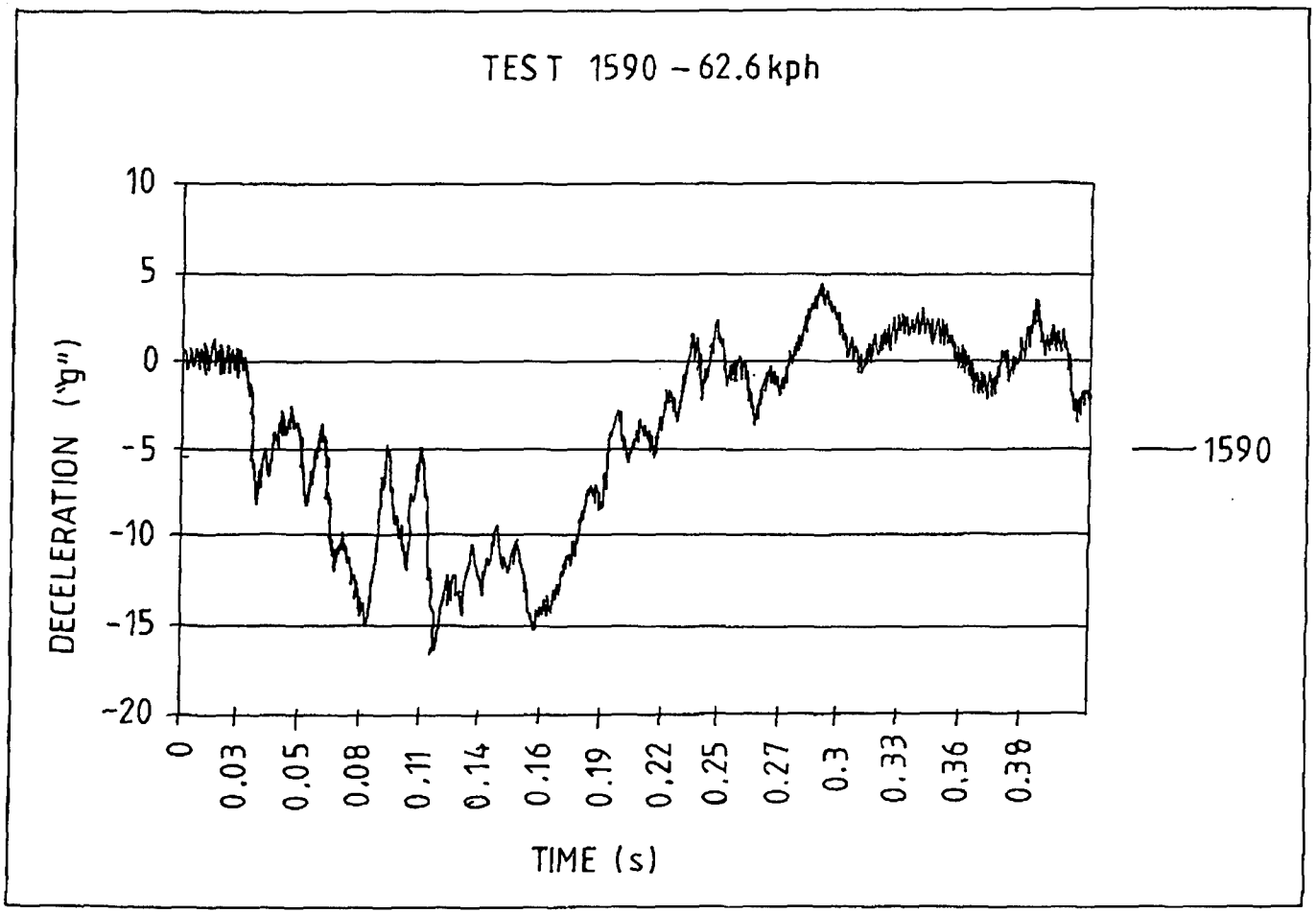
FIG. 4 is a graph of deceleration versus time for a vehicle impact test on a pole of the type shown in FIG. 1.
Figure 5:
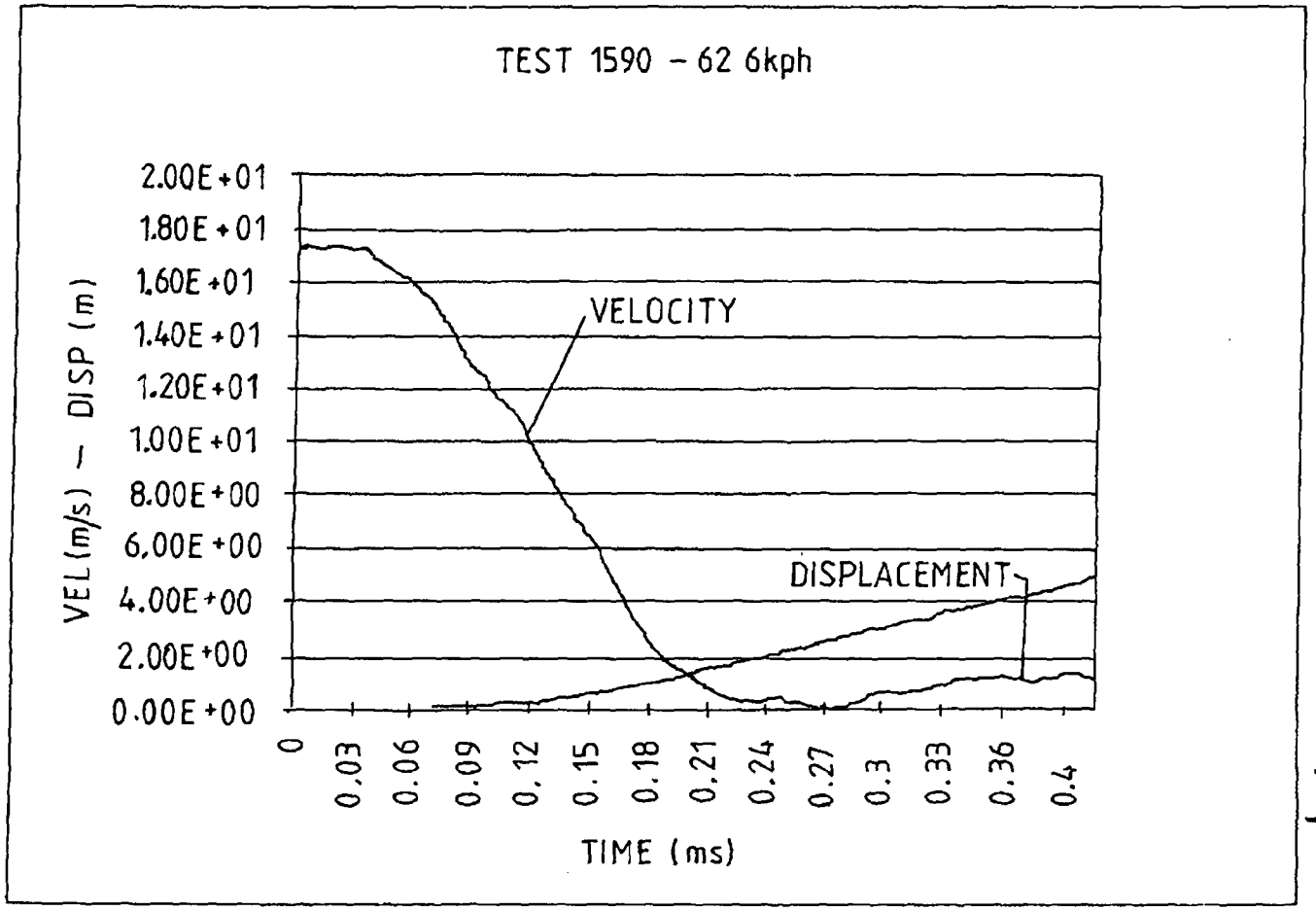
FIG. 5 is a graph of velocity and pole displacement versus time for the vehicle impact test.

FIGS. 4 and 5 present the results of the test. FIG. 4 shows that the rate of deceleration of the vehicle increased until 0.16 s after impact and then steadily decreased thereafter. The deceleration graph of FIG. 4 is mirrored by the velocity graph of FIG. 5. This graph shows that the vehicle velocity decreased steadily through the time period of 0.21 s after impact.

The total plastic deformation (permanent deformation of the pole was 1550 mm and the vehicle front end was 320 mm) was 1870 mm total.

The impact speed of the vehicle was 17.4 mps or 62.6 kph and the maximum deceleration was 16.56 "g". The average deceleration was 4.06 "g". The deceleration is considered to be survivable for a vehicle occupant.

Many modifications may be made to the embodiment of the pole of the present invention shown in the Figures without departing from the spirit and scope of the invention.

By way of example, whilst specific dimensions are given for the pole 5 in FIGS. 1 to 3, the present invention is not so limited and the pole may be any suitable dimensions.

The invention claimed is:

1. An impact absorbing pole positioned in the ground, the pole being formed from steel in sheet form that is folded into a tubular structure having a predetermined cross-sectional shape and welded at abutting side edges and including an outer wall and a hollow interior, the pole including:

a base section that extends into and locates the pole in the ground and a pole section that extends upwardly from the ground, with the base section and the pole section being a one-piece unit; and an area of weakness formed as a plurality of longitudinally spaced slots in the one-piece unit that extends above and below ground and deforms readily above and below ground when the pole is contacted by a vehicle, wherein the pole is positioned in the ground so that impact of a vehicle with the pole initially deforms and flattens the pole at an area of impact with the vehicle and then deforms and flattens, that is, extrudes the pole above and below ground as the vehicle moves forward after initial impact with the pole and then bends and thereby collapses the pole rearwardly over the roof of the vehicle in a controlled way, and wherein some of the plurality of spaced slots extend along the length of the below ground base section, and some of the plurality of spaced slots extend at least partially along the length of the below ground base section and at least partially along the length of the above ground pole section.

2. The pole defined in claim 1 being a tapered pole whereby the transverse cross-sectional area of the pole decreases away from the base end of the pole.

3. The pole defined in claim 1, wherein the pole is free-standing.

4. The pole defined in claim 1, wherein the pole does not include a flange or base plate adapted and configured for mounting to a base.

* * * * *